United States Patent [19]

Weisbach

[11] 4,455,104

[45] Jun. 19, 1984

[54] METAL CONCRETE JOINT FORM AND ADJUSTABLE STAKES

[75] Inventor: Albert P. Weisbach, Louisville, Ky.

[73] Assignee: Cardinal Manufacturing Company, Louisville, Ky.

[21] Appl. No.: 372,495

[22] Filed: Apr. 28, 1982

[51] Int. Cl.[3] ..... E01C 11/04

[52] U.S. Cl. ..... 404/50; 249/3; 249/9; 403/105

[58] Field of Search ..... 404/51, 50, 47, 68, 404/71, 87; 249/3, 9, 6; 403/105, 329, 330

[56] References Cited

U.S. PATENT DOCUMENTS

| | | | |
|---|---|---|---|
| Re. 24,921 | 1/1961 | Wilbur | 404/51 |
| 1,345,179 | 6/1920 | Heltzel | 249/3 |
| 1,753,316 | 4/1930 | Robertson | 404/68 |
| 1,831,613 | 11/1931 | Symons | 403/105 X |
| 3,288,042 | 11/1966 | Gaetke | 404/51 |
| 3,300,920 | 1/1967 | Skaare | 249/3 X |
| 3,401,612 | 9/1968 | Tone | 404/87 X |
| 3,497,172 | 2/1970 | Welch | 249/3 |
| 3,561,721 | 2/1971 | Self | 249/3 X |
| 3,572,225 | 3/1971 | Burton | 404/47 |
| 3,665,778 | 5/1972 | Bohan et al. | 403/329 X |
| 3,784,313 | 1/1974 | Collier, Jr | 404/51 |
| 4,127,352 | 11/1978 | Peters | 404/68 X |
| 4,411,404 | 10/1983 | Weisbach | 249/3 |

OTHER PUBLICATIONS

Key-Loc Joint System Brochure, Form-A-Key Products Div., Cardinal Manufacturing Co.

*Primary Examiner*—Ernest R. Purser
*Assistant Examiner*—Beverly E. Hjorth
*Attorney, Agent, or Firm*—Richard L. Caslin

[57] ABSTRACT

A metal concrete joint form is shown supported on a plurality of interlocking metal stakes for providing a positive, vertically-adjustable, strong locking action between these members. The top end of each stake is flattened and it has a plurality of closely-spaced vertically arranged serrations or ratchet formed on one side thereof. The concrete joint form is an elongated sheet metal member having an inverted hook portion at the top edge of the form with a downturned flange that has its lower edge hemmed on the inside and then folded outwardly to create an upwardly-inclined raw edge of the hem of the flange to serve as a locking pawl for cooperating with the vertical row of serrations or ratchet.

4 Claims, 5 Drawing Figures

METAL CONCRETE JOINT FORM AND ADJUSTABLE STAKES

BACKGROUND OF THE INVENTION

1. Field of the Invention

This invention relates to the art of concrete joint forms that are supported on a plurality of metal stakes to provide a key joint forming member between adjacent slab sections of a monolithically poured concrete slab.

2. Description of the Prior Art

The Wilbur U.S. Pat. No. Re. 24,921 describes a concrete slab key-joint forming member that is supported on a plurality of widely-spaced metal stakes which enables slabs of concrete to be poured simultaneously on both sides of the key-joint forming member. One of the problems experienced with these products has been the possibility of the form not gripping the stake rigidly enough to prevent the form from slipping and floating off before or during the pouring of the concrete.

The next patent to Gaetke U.S. Pat. No. 3,288,042 describes a concrete slab key joint forming strip that is supported on a plurality of widely-spaced metal stakes. The top end of each stake is provided with an aperture. There is a special tool provided for crimping the lower edge of a downturned flange into the aperture for locking the form onto the stake and preventing inadvertent removal of the form from the stake. The use of this tool increases the labor cost of installing these forms on these stakes.

The Tone U.S. Pat. No. 3,401,612 is another patent like that of Gaetke, except that the upper end of the stake does not have an aperture, but it has a notch in each of the opposite sides of the stake so that a tool, such as a crescent wrench, may be used to deform the lower edge of the downturned flange until it interlocks with the notch and makes a mechanical connection between the form and the stake. However, the labor costs for making these adjustments are a disadvantage in using the Tone invention.

The Collier U.S. Pat. No. 3,784,313 describes a concrete slab key joint forming strip that is supported on a plurality of widely-spaced metal stakes. This design provides a means for attaching a concrete slab key joint forming strip to a supporting stake without requiring the use of special tools for assembly of the forming strip on the support stake. The upper end of the forming strip had a generally inverted U-shaped cross section with a base portion having a downwardly-extending hook portion extending from one side thereof and terminating in a distal edge in the form of a weak inwardly-directed, horizontal lip. The upper end of the stake is adapted to abut against the base portion of the upper section of the forming strip. Also, the upper end of the stake includes a protrusion in the form of a tab-like segment which extends outwardly and downwardly from the support stake, whereby this protrusion will snap into engagement with the horizontal lip of the downturned flange so that the forming strip will be retained on the stake. However, this construction envisions that the upper edge of the stake will abut against the base portion of the upper section of the forming strip, and moreover the horizontal lip will engage beneath the lanced protrusion, so that there is no vertical adjustability available in this design. This patent shows a precision design which requires ideal working conditions, close tolerances, and which lacks vertical adjustability and provides a weak locking action between the form and its supporting stakes.

The Heltzel U.S. Pat. No. 1,345,179 describes a portable concrete form with adjustable means for use with concrete structures requiring various heights. A concrete mold form is supported on a pluraltiy of stakes, where each stake is provided with a flange for restricting movement of the stake into the ground. Each stake is provided with a plurality of vertically-arranged notches for supporting a bracket member at various elevations. The concrete form is hung from this bracket member on each stake. In all cases, the stakes of this Heltzel patent protrude above the top edge of the concrete forms so that a screed could not be used, as in the present invention, to move across the top edge of the concrete form that serves as as leveling guide so as to smooth out the concrete surface.

OBJECTS OF THE PRESENT INVENTION

The principal object of the present invention is to provide an interlocking engagement between a metal concrete joint form and its supporting stakes so as to provide a strong, vertically-adjustable, locking action between the form and its stakes.

A further object of the present invention is to provide an elongated metal concrete joint form in combination with a plurality of interlocking metal stakes of the class described, where the top end of each stake is provided with a series of closely-spaced vertically arranged serrations so as to create a ratchet and pawl action between the members so as to obtain both vertical adjustability and a strong locking action.

A further object of the present invention is to provide concrete joint forms with a plurality of spaced, interlocking metal stakes of the class described, where the top portion of the form is provided with an inverted hook member that has a downturned flange that is hemmed on the inside, and the lower portion of this flange is formed outwardly, thereby causing the raw edge of the hemmed flange to be angled upward for directly opposing the direction of the teeth of the serrations on the stake whereby the concrete form may be pushed onto the stake with a minimum of force and will snap into a positive locking action that is variable until the form reaches the correct level.

SUMMARY OF THE INVENTION

The present invention provides an interlocking metal concrete joint form that is supported on a plurality of widelyspaced stakes for use in pouring concrete slabs, where the top end of the stake is provided with a plurality of closely-spaced vertically-spaced arranged serrations formed on one side thereof. The concrete metal form is an elongated sheet metal member having a vertically-extending planar portion with an offset, protruding key portion adjacent its midheight, and an inverted hook portion at the top of the form that is on the side that is opposite the protruding key portion. This hook portion has a downturned flange with the lower edge of the flange provided with a hem on the inside, and the hemmed edge of this flange is folded outwardly at an upwardly-inclined angle to cause the raw edge of the sheet metal to be on the inside of the flange and inclined in an upward direction, thereby reulting in a strong, vertically-adjustable, locking action between the form and its supporting stakes.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
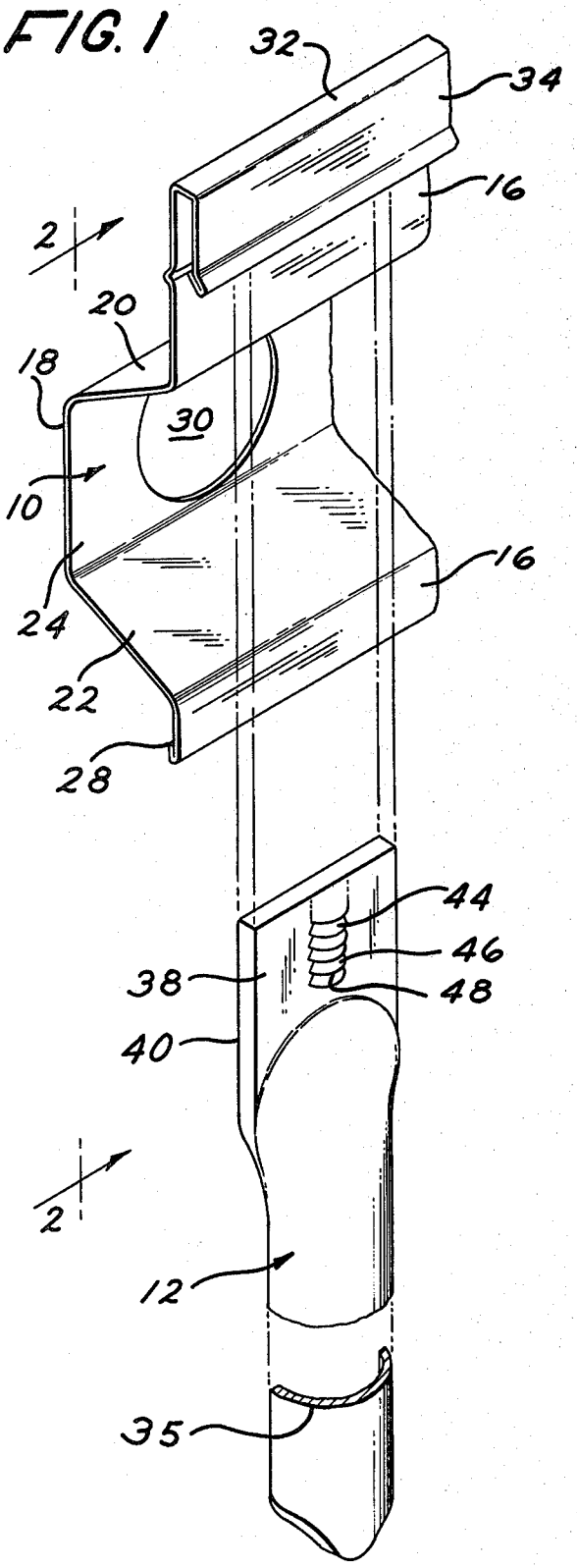
FIG. 1 is a fragmentary, perspective view of one end of a metal concrete joint form, along with a metal stake on which the form is adapted to be supported. Note the flattened top end of the stake having a plurality of closely-spaced arranged serrations formed on one side of the flattened end.

Turning now to a consideration of the drawings, and in particular to the fragmentary, exploded, perspective view of FIG. 1, there is shown a portion of the left end of a metal concrete joint form 10 made according to the present invention. This concrete joint form is an expendable, relatively rigid, elongated sheet metal form that is adapted to be supported on a plurality of metal stakes 12. Non-removable metal concrete joint forms are used extensively in the construction field today, and they are suspended on metal stakes which locate and level the form before the concrete is poured. One of the problems experienced with these products has been the possibility of the form not gripping the stake rigidly enough to prevent the form from slipping or floating off the stake before or during the pouring of the concrete. This problem has been eliminated with the discovery of the present invention.

When the metal concrete joint form 10 is viewed in transverse, cross section, it has a vertically-extending planar portion 16 with an offset, protruding key portion 18 adjacent its midheight. This key portion is a relatively large channel configuration that is set up on its side. This key portion has an upper side wall 20, a lower side wall 22, and a connecting base 24. The lower edge of the elongated concrete joint form 10 is rolled over to form a hem 28 to strengthen the rigidity of the form. These forms come in standard lengths of 10 feet, and they are of various sizes in height, from about 3½inches to about 9½inches, depending on the desired thickness of the concrete slab. The key portion 18 is shown with a hole 30, but it should be understood that knockouts are formed in the key portion, and the knockouts are not removed to form the hole 30 unless there is a need for the hole. These knockouts cut a circular opening but leave an uncut tab so that the knockout remains with the form until the hole is to be created at the work site. This, of course, does not form part of the present invention. These holes are available for nailing purposes or to permit cables to be strung therethrough, and they also may receive dowels or reinforcing bars, as is well known in this art. These concrete joint forms 10 are adapted to be supported on a plurality of widely-spaced stakes 12; thus, provision must be made on the form for accommodating the stakes. The top edge 32 of the concrete joint form 10 is a horizontal flange that extends outwardly from the planar portion 16, and this top edge is on the side of the form 10 that is opposite the key portion 18. This top edge 32 serves as a leveling guide for use with a screed that extends across a pair of these concrete forms 10 and serves to level freshly poured concrete as the screed is drawn along the forms so as to smooth out the concrete surface. An inverted hook portion 34 is suspended from the top edge 32 for mating engagement with the metal stake 12. This inverted hook portion 34 is in the form of a downturned flange 36 that is spaced away from the vertical planar portion 16 in order to receive the top end of the stake 12 therein.

Looking at FIG. 1, the vertical stake 12 is a narrow, heavy galvanized steel construction, which is of semicircular shape in transverse cross section, as seen at 35. The top end 38 of the stake is flattened to create a straight edge 40 on one side of the stake from top to bottom for mating engagement with the vertically-extending planar portion 16.

Figure 2:
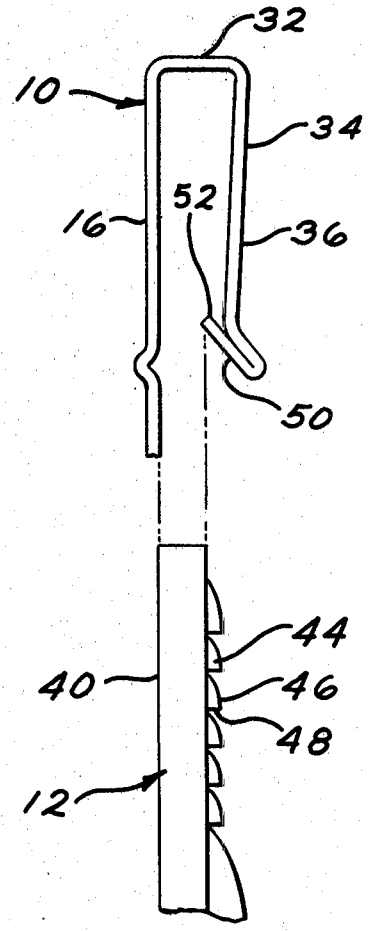
FIG. 2 is an exploded, side elevational view of a fragment of the top portion of the concrete joint form, as well as a fragment of the flattened top end of the stake. This view is taken on the line 2—2 of FIG. 1.

On the flattened top end 38 of the stake 12 is formed a plurality of closely-spaced arranged vertically serrations 44 on the side that is opposite the straight edge 40, as is best seen in FIG. 2. In the preferred embodiment, each serration 44 is in the shape of an upwardly-tapered, semi-conical tooth 46 having a lower, generally horizontal, undercut 48 separating it from the next lower serration 44. It will be understood by those skilled in this art that other specific shapes of serrations could be provided without departing from the present invention. These serrations 44 are formed as embossments by striking the flattened end 38 from the back side or straight edge 40 at the same time the top end 38 is flattened.

Figure 3:
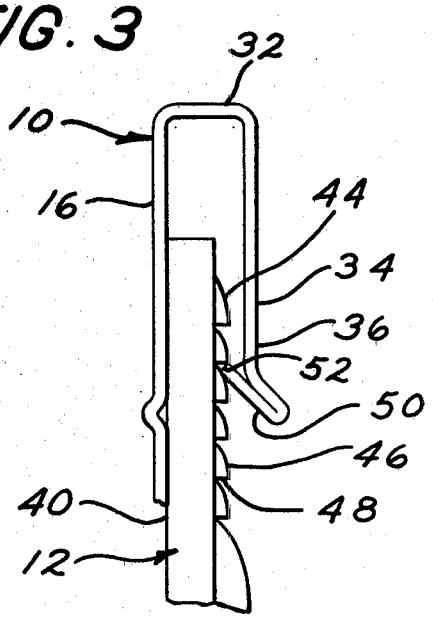
FIG. 3 is a side elevational view, similar to that of FIG. 2, with the concrete joint form in interlocking relationship with the supporting stake. This view shows the strong, vertically-adjustable, locking action in the nature of a ratchet and pawl between the form and its supporting stake.

Now turning attention to the shape of the inverted hook portion 34 in FIG. 2, the lower edge of the downturned flange 36 is formed with a hem 50 on the inside of the flange 36. Then this hemmed edge is folded outwardly into an angle of about 45 degrees to cause the rough, raw edge 52 of the sheet metal to be on the inside of the flange 36 and inclined in an upward direction. This free edge 52 of the hem serves as a pawl for cooperation with the vertical row of serrations 44 on the flattened top end of the stake 12, as can best be seen in the assembled view of FIG. 3. It is well to note the interaction between the upwardly-tapered, semi-conical tooth 46 and the raw edge 52 of the pawl that is angled upward to slide easily over the semi-conical taper with a minimum of force and then snap into the lower undercut 48 and directly oppose the underside of the tooth 46 to give a strong, adjustable locking action between the form 10 and its supporting stake 12. These vertically-arranged serrations may be considered as a ratchet, and the raw edge 52 and the hem 50 of the flange 36 may be considered as a locking pawl that is stressed in compression in the event a lifting force were applied to the form tending to lift the form from the stakes. While it is an easy matter to insert the flattened end 38 of the stake 12 into the inverted hook portion 34 of the form, these members cannot be inadvertently disengaged. If, for some reason, it is necessary to remove the form from the stake, a screwdriver or other tool could be inserted from the underside up into the inverted hook portion 34 to spread the flange 36 outwardly and disengage the pawl 52 from the serrations 44.

Figure 4:
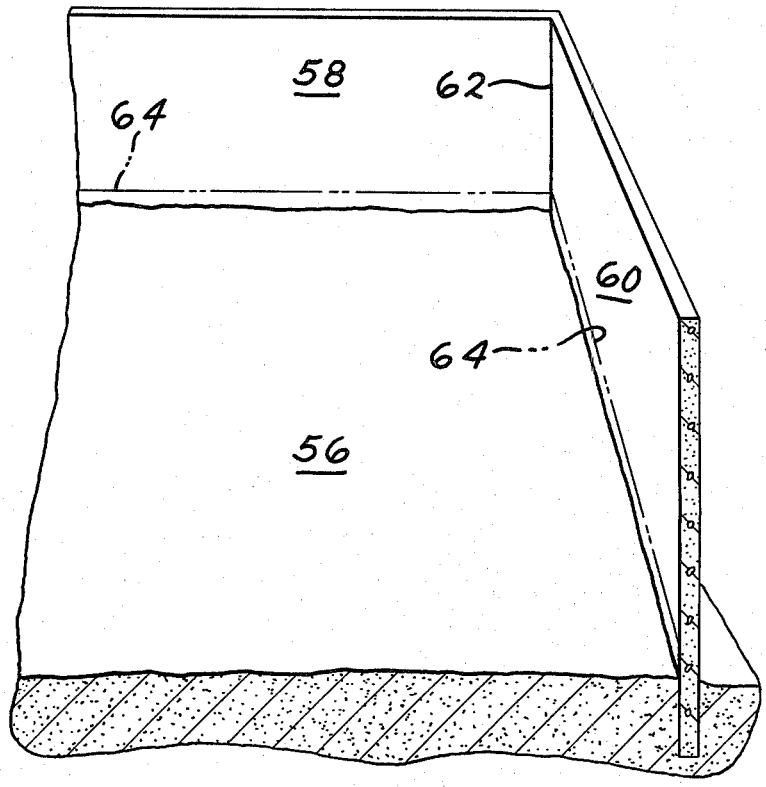
FIG. 4 is a fragmentary, perspective view showing a building site with two vertical walls connected at the corner, where a monolithic concrete slab is to be poured to form a floor.

Now turning to a consideration of the perspective view of FIG. 4, there is shown ground level 56 and two vertical walls 58 and 60 which are joined at the corner 62. A chalk line 64 is made at the base of each wall 58 and 60 to indicate the level of the concrete slab that is to be poured to form a concrete floor.

Figure 5:
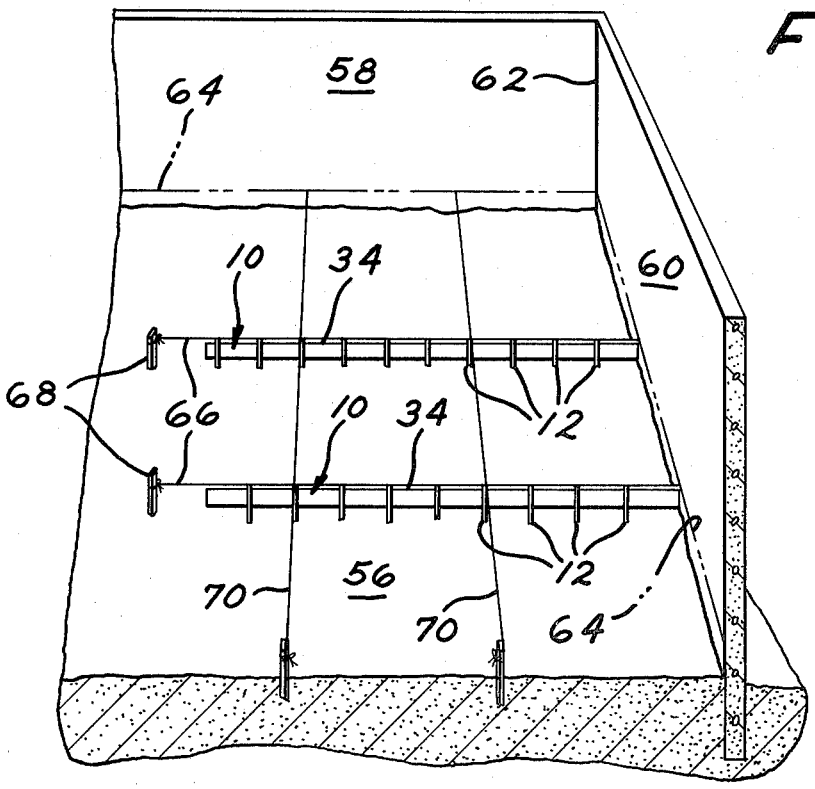
FIG. 5 is a fragmentary, perspective view, similar to that of FIG. 4, showing a line chalked at the bottom of the two vertical walls to denote the concrete floor level, and two parallel concrete joint forms, each assembled on a plurality of metal stakes, there being a pair of lines stretched transversely across the concrete joint forms for leveling purposes.

In FIG. 5, there is shown two stretch lines 66 erected on stakes 68 to indicate the finished floor elevation. Then a plurality of vertical stakes 12 are driven into the ground at widely-spaced locations along the length of the stretch lines 66. These stakes 12 are hammered into the ground until the top edge of the stake is generally near the stretch line 66. Then a concrete joint form 10 is supported on each line of stakes 12. Then a pair of transverse stretch lines 70 are erected across the two concrete joint forms 10, and then the forms 10 are driven down onto the flattened top end of the stakes 12 until these forms 10 are properly leveled. Since there is an easy slippage of the raw end or pawl 52 of the inverted hook portion 34 of the form over the serrations 44, it is not necessary to use a hammer to drive the form 10 onto the stakes to obtain the proper level of the form. Experience has shown that the use of the present invention produces a more accurate placement of these forms 10 into their desired level positions.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An interlocking metal concrete joint form and supporting stakes for use in pouring concrete slabs comprising:

a. a plurality of expendable metal stakes, each having a flattened top end with a plurality of closely-spaced vertically-arranged serrations formed on one side of the flattened end;

b. and an expendable, relatively rigid, elongated sheet metal form with a transverse, cross section having a vertically extending planar portion with an offset protruding key portion adjacent its midheight, and an inverted hook portion at the top edge of the form on the side that is opposite the said protruding key portion, said hook portion having a downturned flange that is spaced away from the said vertical planar portion, the lower edge of the said flange being hemmed on the inside, where this hemmed edge is folded outwardly at an upwardly-inclined angle to cause the rough, raw edge of the sheet metal hem to be on the inside of the flange and inclined in an upward direction to serve as a locking pawl;

c. where the spacing between adjacent serrations is about equal to the thickness of the material of the locking pawl to create a ratchet and pawl interlocking relationship, whereby when the stakes are widely separated and supported upright in the ground, and the metal form is lowered onto the stakes and driven into place, the inclined raw edge of the hemmed edge of the flange will spring past certain of the serrations on each stake until the form is leveled throughout, thereby resulting in a strong locking action between the form and its supporting stakes, while the locking pawl is stressed in compression in the event a lifting force were applied to the form tending to lift the form from the stake.

2. The invention as recited in claim 1, wherein the said closely-spaced vertically arranged serrations are embossed on the flattened top end of each stake, each serration being in the shape of an upwardly-tapered, semi-conical tooth having a lower, generally horizontal, undercut separating it from the next lower serration.

3. The invention as recited in claim 2, wherein the said upward inclination of the hem of the flange of the said hook portion is matched to the said upward taper of each tooth of the serrations to prevent the form from inadvertent removal from the stake.

4. The invention as recited in either claims 1, 2 or 3, wherein the plurality of expendable metal stakes are adapted to be supported in the ground at slightly different elevations, and yet the vertically-arranged serrations of each stake are capable of a strong locking action with the locking pawl formed by the upwardly-inclined hemmed edge of the downturned flange of the form to ensure that the topmost edge of the form is level.

* * * * *